US005107635A

United States Patent [19]

Carpenter

[11] Patent Number: 5,107,635

[45] Date of Patent: Apr. 28, 1992

[54] GUTTER SYSTEM

[76] Inventor: Scott S. Carpenter, 1908 Carolyn Dr., Shelby, N.C. 28150

[21] Appl. No.: 668,599

[22] Filed: Mar. 13, 1991

[51] Int. Cl.[5] ..... E04D 13/00; E02B 11/00

[52] U.S. Cl. ..... 52/12; 52/16; 52/169.5; 210/474; 210/484

[58] Field of Search ..... 52/11, 12, 14, 15, 16, 52/169.5; 210/474, 484, 154

[56] References Cited

U.S. PATENT DOCUMENTS

| | | |
|---|---|---|
| 316,578 | 4/1885 | Schumann et al. . |
| 474,442 | 5/1892 | Byers et al. . |
| 571,711 | 11/1896 | Twist . |
| 803,316 | 10/1905 | Vogel . |
| 939,838 | 11/1909 | Hensler . |
| 2,669,197 | 2/1954 | Van Duzer . |
| 3,550,381 | 12/1970 | South . |
| 4,925,342 | 5/1990 | Hendy ..... 52/169.5 X |

*Primary Examiner*—David A. Scherbel
*Assistant Examiner*—Robert Canfield
*Attorney, Agent, or Firm*—Dority & Manning

[57] ABSTRACT

An improved rain gutter apparatus is arranged to include an elongated and flexible inner contoured surface element formed with outwardly extending projections on both sides thereof and being completely wrapped in an outer covering material with a multitude of openings. When positioned within a rain gutter, rainwater flowing along the gutter is directed into and along water channels formed by the projections. An end of the apparatus is bent so as to extend a short distance into the downspout associated with the gutter thereby ensuring uninterrupted flow of rainwater therein. The covering material prevents the intrusion of leaves and other debris from entering the water channels so as to ensure clog free flow of rain water.

22 Claims, 3 Drawing Sheets

GUTTER SYSTEM

BACKGROUND OF THE INVENTION

This invention relates to gutter systems, and more particularly, to rain gutters of the type mounted along and under edges of roofs for collecting rainwater and conducting the same to one or more downspouts.

In the prior art, the most common devices for ensuring the flow of rainwater to and along a gutter for eventual movement to a downspout comprise various forms of flat screen material generally devised to be placed upon the top of the gutter. Eventually, leaves, twigs, tree bark and other foreign material build up on these screens and impede the flow of the rainwater into the gutter and cause the rainwater to run off the top surface of the wet leaves and free fall to the ground surface. The weight of the accumulated leaves can also collapse the prior art screens into the gutter. Another disadvantage of many of the prior art devices is that the screening material is visible all along the rain gutter, thus contributing to the unsightly appearance of the rain gutter itself.

A further disadvantage of the prior art screening materials becomes evident as leaves build up upon the screening material. If routine cleaning is not employed, the accumulation of wet leaves will impose undue weight upon the gutter along one or more sections of the edge of the roof thereby subjecting the rain gutter's mounting structure to an unacceptable weight which the structure may not be able to maintain. Since present day rain gutter structures are relatively light, present day mounting means are relatively flimsy, and the weight of accumulated wet leaves will eventually cause the mounting structure to pull away from the house and fall to the ground level, perhaps damaging the house during the fall.

One such planar screening device arranged to be mounted on top of a rain gutter is disclosed in U.S. Pat. No. 3,550,381. Similarly, U.S. Pat. No. 474,442 discloses a planar screen arranged to be mounted within the gutter. A modified form of such screen is disclosed in U.S. Pat. No. 939,838.

Another form of device for solving the problems associated with rain gutters are those which are mounted adjacent the entry to the downspout for the gutter. Such devices usually take the form of strainers which surround the entry opening for the downspout. These devices, examples of which are disclosed in U.S. Pat. Nos. 316,578, 571,711, 803,316 and 2,669,197 are formed as planar screens which may be bent at suitable angles to surround the opening for a downspout.

SUMMARY OF THE INVENTION

The present invention recognizes and addresses the foregoing disadvantages, and others, of the prior art gutter screening devices. Accordingly, it is an object of the present invention to provide an improved gutter or gutter insert that will ensure that the flow of rainwater along a rain gutter on the way to a downspout is unimpeded by the accumulation of leaves and other debris which fall within the gutter.

Another object of the invention is to provide an improved gutter system which is easy to install in a rain gutter and which is made of low-cost materials easily obtainable in the market.

These and other objects are achieved generally by providing an apparatus adapted for insertion in a rain gutter for preventing leaves and other debris from clogging the gutter comprising an inner contoured surface element adapted to be positioned inside a gutter and including means for forming water channels within the gutter. The apparatus includes an outer covering material with a multitude of openings, the outer covering material at least partially surrounding the inner contoured surface element so that leaves and other debris will be restrained by the outer covering material and rain water can flow through the outer covering material and into and along the channels formed by the inner contoured surface element.

In a preferred embodiment, the means for forming water channels within the gutter comprises projections extending outwardly from at least one side of the inner contoured surface element. The outer covering material may completely surround the inner contoured surface element or may be bonded to one or both sides. In addition, the inner contoured surface element and outer covering are preferably adapted to extend into the downspout of the gutter.

Further, it is also contemplated that the inner contoured surface element and outer covering be made as a part of the gutter, rather than as an insert so that a ready made gutter embodying the present invention could be installed.

It should be understood to one of ordinary skill in the art that features of the various embodiments of the present invention, in whole or in part, may be interchanged. Other objects, features and aspects are discussed in greater detail below.

DESCRIPTION OF THE DRAWINGS

A full and enabling disclosure of the present invention, including the best mode thereof, to one of ordinary skill in the art, is set forth more particularly in the remainder of the specification including reference to the accompanying figures in which.

DESCRIPTION OF THE PREFERRED EMBODIMENT

It is to be understood by those of ordinary skill in the art that the present discussion is a description of exemplary embodiments only, and is not intended as limiting the broader aspects of the present invention, which broader aspects are embodied in the exemplary constructions.

Figure 1:
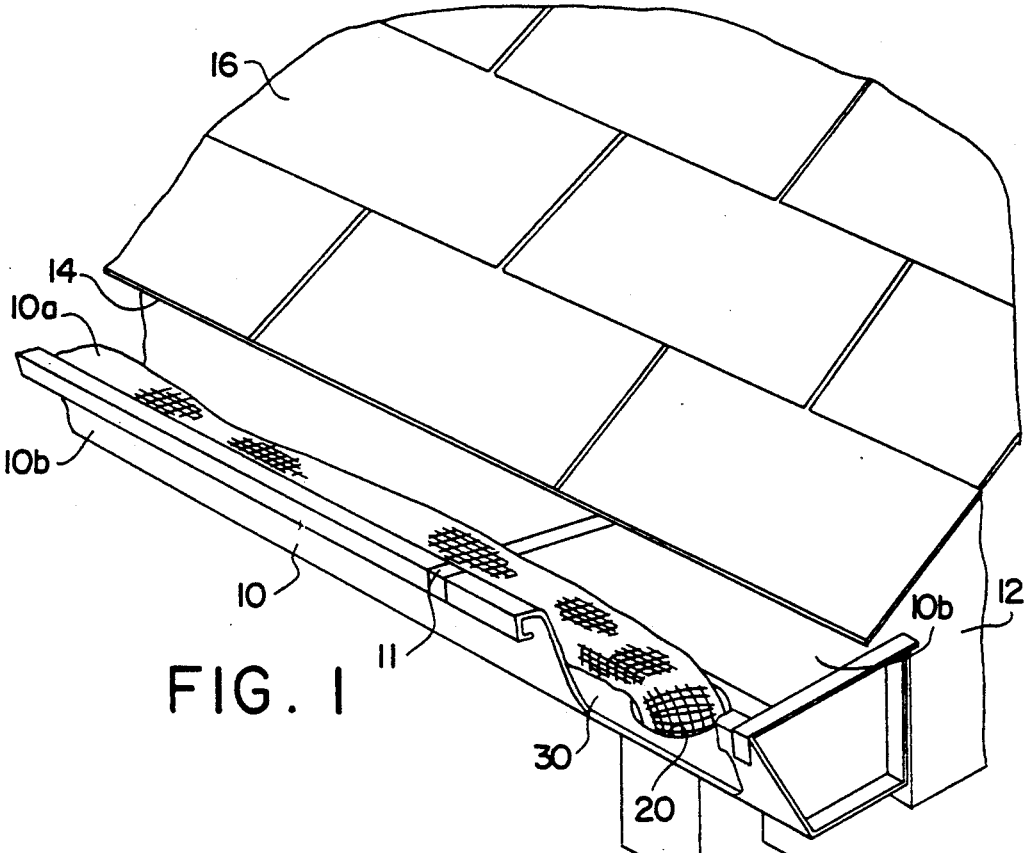
FIG. 1 is an isometric view, with parts broken away, of the present invention.

FIG. 1 illustrates a typical rain gutter 10, including a bottom **10*a* and sides 10*b*, suitably installed upon a building 12, such as a residential house, running along below the drip edge 14 of a roof 16** for the house. A downspout 18 associated with the gutter 10 is also installed upon the building adjacent generally one corner thereof. As customary in these structures, the end of the gutter 10 is formed with an opening 20 for communication with the downspout for directing rainwater therein and eventual removal to a suitable sewer system or open ground area.

It should be understood that the present invention is adapted to be applied to all types of rain gutters 10 including those having cross-sectional shapes such as semi-circular, square, trapezoidal, etc. Various hanging devices may be employed to attach the gutter 10 to the building 12. Such devices of the conventional type may comprise side hangers and strap arrangements, or long nails extending through tubular elements held along the top edges of the gutter. In any of these hanging arrangements, there is no interference with the structural elements of the present invention, and in fact, some of the hanging elements may serve to help hold the apparatus of the present invention in place.

Figure 2:
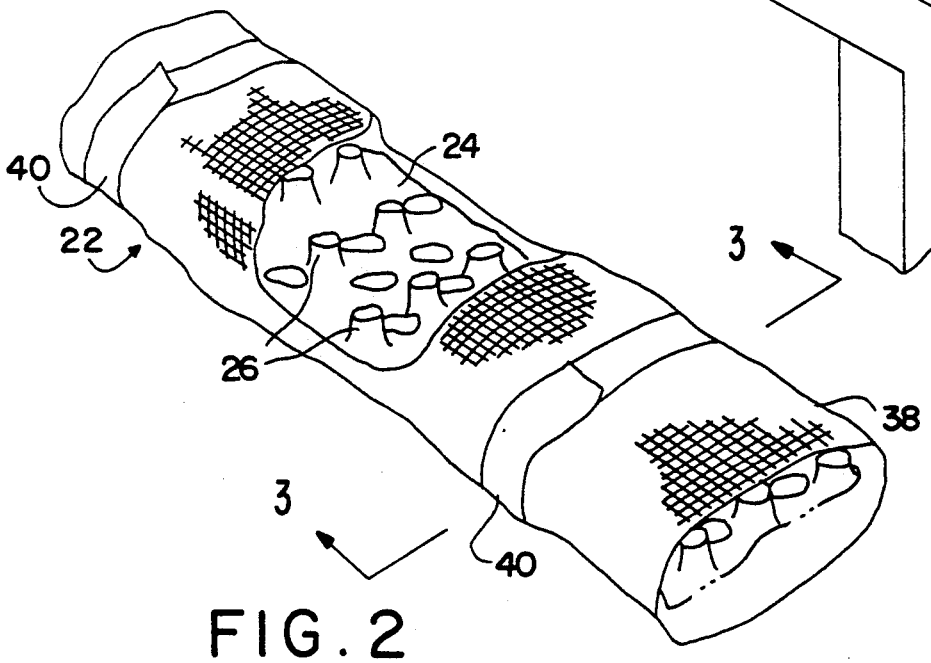
FIG. 2 is an isometric view showing the details of the inner contoured surface element and outer covering material utilized in the present invention.
Figure 3:
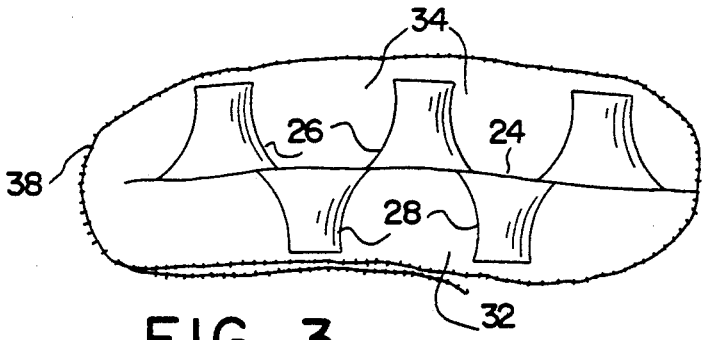
FIG. 3 is a cross-sectional view taken along the lines 3—3 of FIG. 2 illustrating the projections formed on the inner contoured surface element.

The present invention as shown in FIG. 2, and generally indicated by the reference numeral 22, includes a flexible, elongated inner contoured surface element 24, preferably made of flexible plastic material, being formed with upper protruding projections 26 and lower protruding projections 28 (shown in FIG. 3). The upper and lower projections may be hollow, or solid, and the inner contoured surface element may include a series of holes therein to facilitate transfer of water from the top of the inner element to the bottom. The width of the inner element 24 is preferably such as to permit the apparatus 22 to be placed on the floor 30 of the gutter 10. When so placed (as illustrated in FIG. 3), water channels 32 are formed along and around the projections 28 between the inner element 24 and the floor 30 for the free flow of water therethrough. Similarly, water channels 34 are formed in, around and between the upper projections 26 for the free flow of water on the inner element.

An outer covering material with a multitude of openings 38, such as plastic screening or the like, is arranged to surround the inner element 24 over the tips of the projections 26 and/or 28 along the length thereof. The outer covering material 38 may be retained in its surrounding position by suitable straps such as a tape material 40 which wraps tightly around the outer covering material spacially along its length, or any other material that would hold the outer covering material in place. Alternatively, if appropriate polymeric or other materials are employed, the outer covering material may be bonded to the inner element, for example, by a heat bonding process or by the use of adhesive upon the tips of the projections 26, 28. In such an embodiment, it would not be necessary for the outer covering material to completely surround the inner element. In addition, any type material that would allow the water to penetrate to the inner element could be used as the outer covering element, such as, for example, plastic screen material. Preferably, but not to be limited thereby, the inner element 24 may be approximately three inches wide and one inch tall by virtue of the dimensions of the projections 26, 28.

The improved gutter apparatus 22, as shown in FIGS. 1 and 2, may be easily installed within the gutter 10 by inserting the same between hangers 11 utilized to mount the gutter to the building 12. The apparatus 22 may be cut to a suitable length sufficient to serve the needs in maintaining the free flow of rainwater to the downspout 18. As shown in FIG. 1, a portion of the apparatus 22 is preferably directed downwardly through the opening 20 and into the downspout 18 in order to ensure that the rainwater in the gutter will proceed to the entry of the downspout and also to protect the downspout opening from the accumulation of leaves and other fallen debris.

In use, with the apparatus 22 positioned as shown in FIG. 1, rainwater flowing down the roof 16 and into the gutter 10 will have unimpeded flow to the downspout 18. Water will flow or drop onto the outer covering material 38 and flow therethrough. Water entering the interior of the gutter flows in the water channels above and below the inner contoured surface element 24, in and around the projections 26, 28. The outer covering material 38 prevents debris from interrupting this water flow for the entire length of the apparatus 22 and into the downspout 18.

Since the inner contoured surface element and outer covering material are preferably made of flexible plastic material, the apparatus 22 is flexible throughout its length and can easily be placed within and manipulated along the gutter 10, and easily bent to extend downwardly into the downspout.

Figure 8:
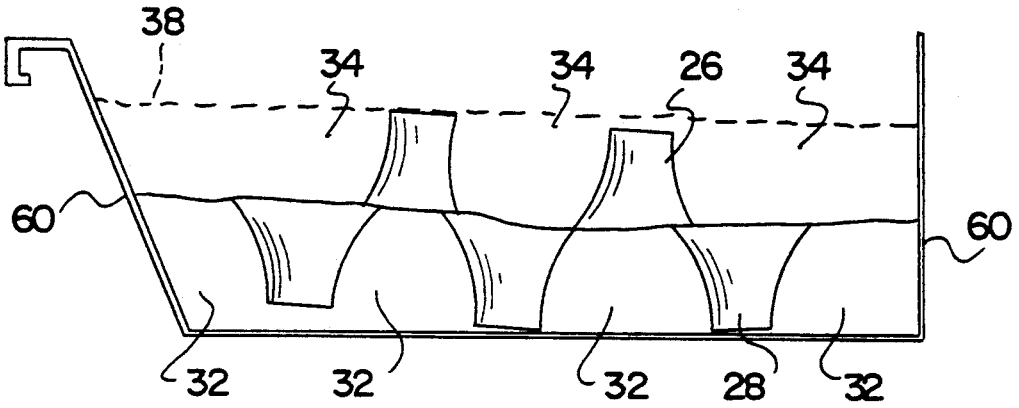
FIG. 8 is a cross-sectional view of an embodiment of the present invention made integrally within a gutter.

In another embodiment of the present invention as illustrated in FIG. 8, the apparatus 22 may be permanently incorporated into a gutter, instead of used as an insert. In such embodiment, the apparatus could be attached within the gutter, such as at 60, so as to form water channels 32, 34 and would not necessarily have to be flexible. Such an embodiment would form water channels 32, 34 with the protrusions covered by an outer covering material 38 within the gutter. The protrusions could also be molded into the gutter, or embedded into the floor, side walls, etc., of the gutter.

Figure 4:
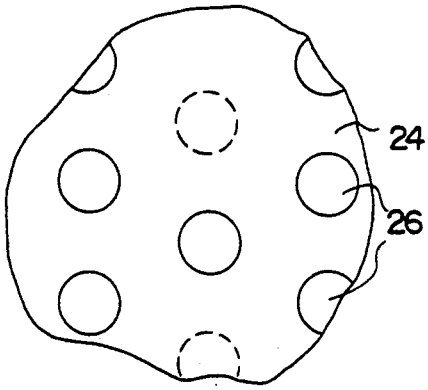
FIGS. 4–7 are partial views of alternate forms of the projections on the inner contoured surface element for forming water channels therearound.

The projections 26, 28 are circular in cross-section and taper outwardly from their outer ends to their base at the inner element 24. Such projections may be formed easily by a stamping operation relative to a sheet of plastic material and arranged so the projections 26 are arranged alternately or staggered relative to the projections 28, as is shown in FIG. 4. In addition, the projections can be molded or formed in any other suitable manner.

Figure 5:
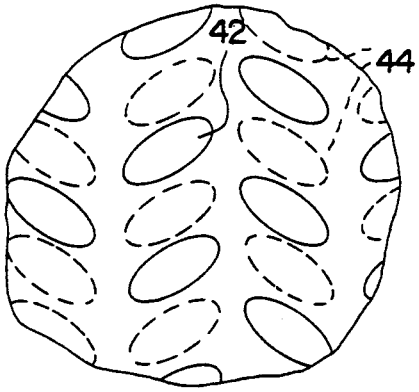
Figure 6:
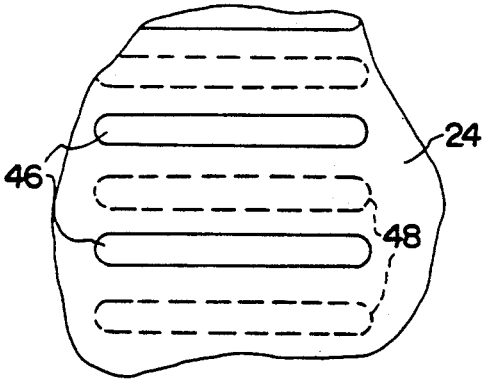
Figure 7:
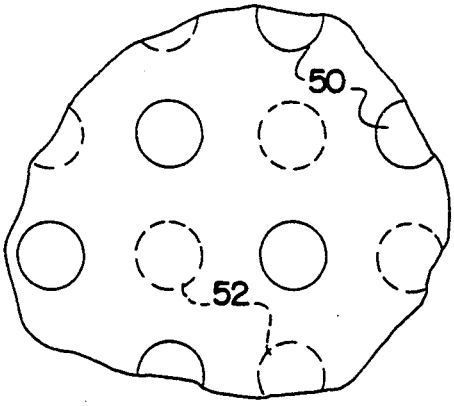

Other forms of protruding projections may be utilized for inner element 24 such as illustrated in FIGS. 4–7. As illustrated in FIG. 5, the cross-sectional shapes of the projections may also be oval and have their main axes at angles relative to each other, as shown by the alternate form of projections 42, 44. As illustrated in FIG. 6, the upper and lower protruding projections 46, 48 can be elongated and extend transversely from near one side edge of the inner element 24 to the other. Further, as shown in FIG. 7, the upper and lower projections 50, 52 may be arranged in alignment rather than in alternating or staggered lines as shown in FIG. 4. In addition, it is within the scope of this invention for the upper and lower projections to be of any shape, size or orientation that would provide channels for the flow of the rainwater, or for either the upper or the lower projections to be omitted thereby forming channels just on the top or bottom of the inner element.

Figure 9:
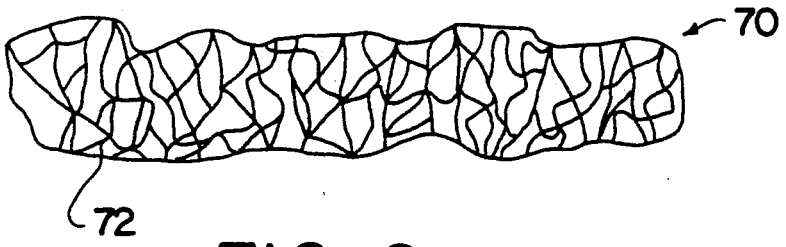
FIG. 9 is an end view of the inner contoured surface element of an alternate embodiment.

In an alternate embodiment, the inner contoured surface element can comprise a preformed material having interstices throughout large enough to permit water to flow therethrough in the same manner as the channels described above. Such an inner surface element, as illustrated at 70 in FIG. 9, would necessarily be rigid enough so as not to collapse under the weight of leaves. In addition, such an inner surface element can be formed to have protruding projections similar to the above-described embodiment but formed of the material with this embodiment. The inner element of this embodiment can be a skeletal structure formed from a random array of filamentary material as illustrated at 72. The filamentary material can be a plastic material or wire or any other material that is sufficiently malleable to allow for forming the product and sufficiently rigid to support the leaves and debris when made into the inner element.

From the foregoing, it will be appreciated that the present invention provides an improved gutter device that will ensure that the build-up of leaves and other debris will not interfere with the free flow of rainwater along a gutter. In accomplishing this goal, the apparatus 22 is relatively deep, that is, has a substantial thickness for the formation of water channels whereby the accumulation of leaves upon the outer covering material will not interrupt water flow. The heights of the upper and lower projections 26, 28 may be suitably dimensioned to establish optimum flow rates for the particular installation. Only an occasional cleaning of the gutter may be necessary for those leaves and debris which have accumulated.

This device can also assist in cleaning the gutter. When the device is lifted, the leaves and other debris will also be lifted out of the gutter. In addition, it should be noted that the projections prevent the outer covering material from collapsing under the weight of the leaves and blocking the channels formed in the gutter.

It will also be appreciated that in one embodiment, the apparatus 22 is flexible and may be easily mounted within a conventional gutter, and may be cut to desired length from a supply roll of the apparatus and bonded together in order to permit the use of the device around corners. Once cut to a desired length, the apparatus may be manipulated, installed, or removed without the aid of tools and special mounting devices for the apparatus itself.

These and other modifications and variations to the present invention may be practiced by those of ordinary skill in the art, without departing from the spirit and scope of the present invention, which is more particularly set forth in the appended claims. The embodiments disclosed herein and portions thereof may be interchangeably used with all other embodiments disclosed. Furthermore, those of ordinary skill in the art will appreciate that the foregoing description is by way of example only, and is not intended to be limitive of the invention so further described in such appended claims.

What is claimed is:

1. An apparatus for insertion in a rain gutter for preventing leaves and other debris from clogging the gutter comprising:

a flexible inner contoured surface element adapted to be positioned inside a gutter and downspout and including means for forming water channels within the gutter; and a flexible outer covering material with a multitude of openings therein, said flexible outer covering material at least partially surrounding said inner element so that leaves and other debris will be restrained by the covering material and rain water can flow through the openings in the covering material and into and along the channels formed by the inner contoured surface element.

2. The apparatus as defined in claim 1 wherein said outer covering material completely surrounds said inner contoured surface element.

3. The apparatus as defined in claim 1 wherein said outer covering material is bonded to the upper and lower sides of said inner contoured surface element.

4. The apparatus as defined in claim 1 wherein said means for forming water channels comprise projections extending outwardly from at least one side of said inner contoured surface element.

5. The apparatus as defined in claim 4 wherein said projections extend outwardly from both sides of said inner contoured surface element.

6. The apparatus as defined in claim 5 wherein said projections on one side of said inner contoured surface element are arranged in staggered relationship relative to the projections on the other side of said inner element.

7. The apparatus as defined in claim 1 wherein said inner contoured surface element and outer covering material are flexible permitting the bending of the apparatus without interrupting the flow of rainwater therealong.

8. The apparatus as defined in claim 6 wherein said gutter includes a downspout and said inner contoured surface element and said outer covering are flexible so that the apparatus may be bent at one end thereof and arranged so that said one end extends into the downspout.

9. The apparatus as defined in claim 1, wherein said outer covering material is plastic screen material.

10. The apparatus as defined in claim 1, wherein said inner contoured surface element comprises a substantially rigid preformed material having interstices throughout.

11. An improved gutter for an above ground structure, said improved gutter comprising:

a gutter structure, said gutter structure including at least a bottom, sides, and means for mounting on an above ground structure;

an inner contoured surface element located inside said gutter structure, said inner element including means of forming water channels in said gutter; and an outer covering material with a multitude of openings, said outer covering material at least partially surrounding said inner contoured surface element so that leaves and other debris will be restrained by the outer covering and rain water can flow through the outer covering and into and along the water channels.

12. An improved gutter as disclosed in claim 11, wherein said outer covering completely surrounds said inner element.

13. An improved gutter as disclosed in claim 11, wherein said outer covering is bonded to the upper and lower sides of said inner element.

14. An improved gutter as disclosed in claim 11, wherein said means for forming water channels comprises projections extending outwardly from at least one side of said inner element.

15. An improved gutter as disclosed in claim 14, wherein said projections extend outwardly from both sides of said inner element.

16. An improved gutter as disclosed in claim 15, wherein said projections on one side of said inner element are arranged in staggered relationship relative to the projections on the other side of said inner element.

17. An improved gutter as disclosed in claim 11, wherein said inner contoured surface element and outer covering material are flexible permitting the bending of the apparatus without interrupting the flow of rainwater therealong.

18. An improved gutter comprising:

a gutter structure, said gutter structure including at least a bottom and sides;

an inner contoured surface element located inside said gutter structure, said inner element including means for forming water channels in said gutter; and an outer covering material with a multitude of openings, said outer covering material at least partially surrounding said inner contoured surface element so that leaves and other debris will be restrained by the outer covering and rain water can flow through the outer covering and into and along the water channels, wherein said inner contoured surface element and outer covering material are flexible permitting the bending of the apparatus without interrupting the flow of rainwater therealong, and wherein the gutter structure includes a downspout and at least a portion of the inner element and covering material extend into the downspout.

19. The gutter as defined in claim 11, wherein the outer covering material is plastic screen material.

20. The gutter as defined in claim 11, wherein said inner contoured surface element is made integrally within said gutter.

21. An apparatus for insertion in a rain gutter for preventing leaves and other debris from clogging the gutter comprising:

a flexible inner contoured surface element adapted to be positioned inside a gutter and downspout, and including means for forming water channels within the gutter, said means for forming water channels comprising projections extending outwardly from at least one side of said inner contoured surface element; and a flexible outer covering material with a multitude of openings therein, said flexible outer covering material at least partially surrounding said inner element so that leaves and other debris will be restrained by the covering material and rain water can flow through the openings in the covering material and into and along the channels formed by the inner contoured surface element and into the downspout;

said outer covering material being retained in surrounding relationship to the inner contoured surface element by a plurality of spaced apart strips wrapped around said outer covering material.

22. An apparatus for insertion in a rain gutter for preventing leaves and other debris from clogging the gutter, said apparatus comprising:

a flexible inner contoured surface element adapted to be positioned inside a gutter and including means for forming water channels within the gutter, said inner contoured surface element comprising a substantially rigid preformed material having interstices throughout; and a flexible outer covering material with a multitude of openings, said outer covering material at least partially surrounding said inner element so that leaves and other debris will be restrained by the covering material and rain water can flow through the openings in the covering material and along the inner contoured surface element.

* * * * *